US008189826B2

(12) United States Patent
Sun et al.

(10) Patent No.: US 8,189,826 B2
(45) Date of Patent: May 29, 2012

(54) DISPLAY DEVICE

(75) Inventors: Zheng-Heng Sun, Taipei Hsien (TW); An-Gang Liang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 309 days.

(21) Appl. No.: 12/606,201

(22) Filed: Oct. 27, 2009

(65) Prior Publication Data

US 2011/0026756 A1 Feb. 3, 2011

(30) Foreign Application Priority Data

Jul. 30, 2009 (CN) ..... 2009 1 0305018

(51) Int. Cl.
*H04R 5/02* (2006.01)

(52) U.S. Cl. ..... 381/306; 381/386; 381/388

(58) Field of Classification Search ..... 381/388; 248/279

See application file for complete search history.

(56) References Cited

U.S. PATENT DOCUMENTS 6,100,942 A * 8/2000 Hollenbaugh et al. ..... 348/836
2007/0274547 A1* 11/2007 Ueno ..... 381/306

* cited by examiner

*Primary Examiner* — Davetta W Goins
*Assistant Examiner* — Amir Etesam
(74) *Attorney, Agent, or Firm* — Altis Law Group, Inc.

(57) ABSTRACT

A display device includes a display, and a pair of sound boxes. The sound boxes are adjustably fixed to the display via at least two fixing members.

4 Claims, 4 Drawing Sheets

DISPLAY DEVICE

BACKGROUND

1. Technical Field

The present disclosure relates to a display device.

2. Description of Related Art

With the widespread use of computers, the computers are playing a more and more important role in people's lives. Most people choose a desktop computer for family use. Compared to notebook computers, desktops are typically more reasonably priced and easy to upgrade. However, desktop computers require many peripherals, such as speakers, keyboard, mouse and so on to fully take advantage of them. These computer peripherals take up a lot of a desk space, making the desk crowded and messy.

DETAILED DESCRIPTION

Figure 1:
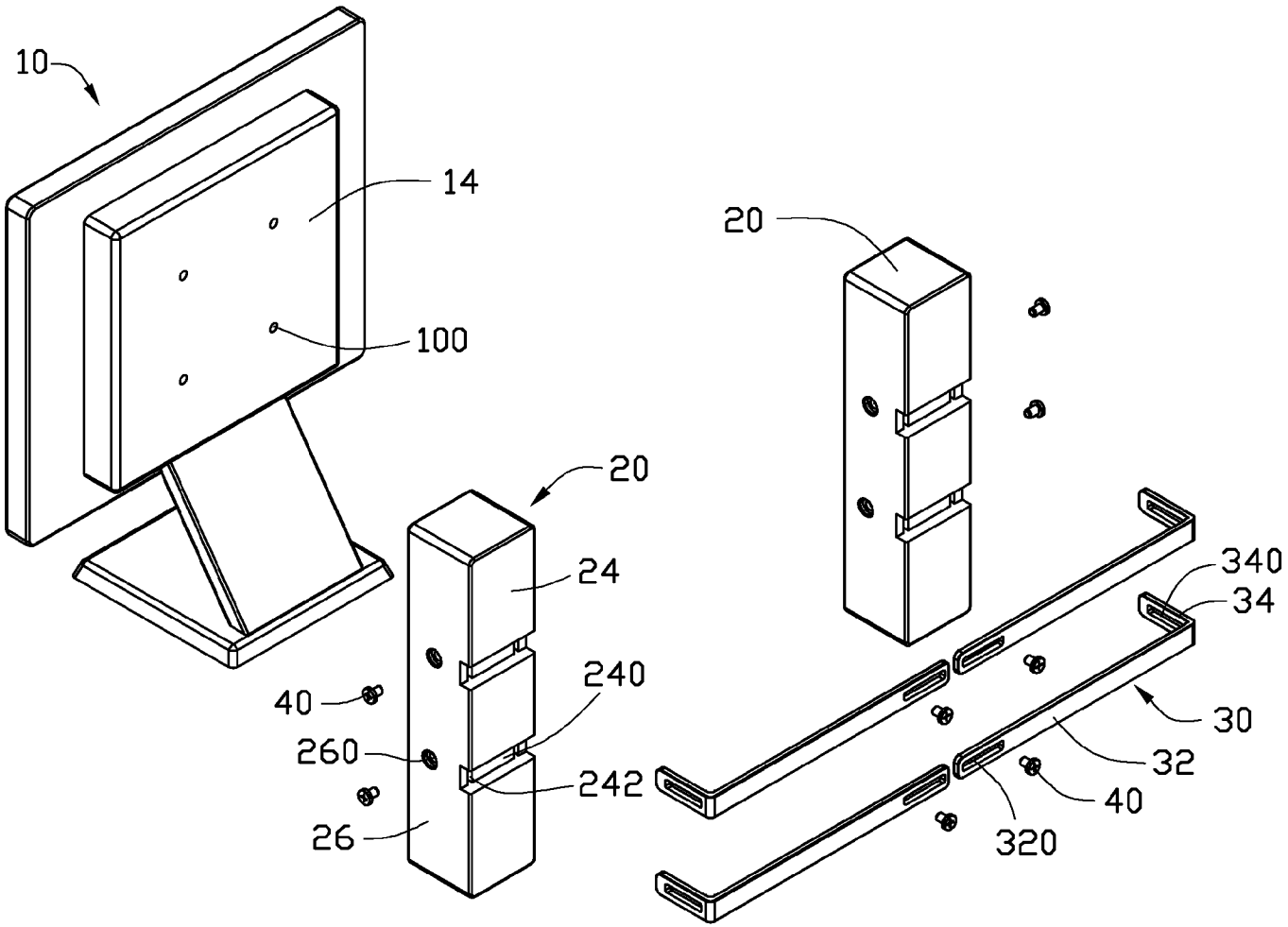
FIG. 1 is an exploded, isometric view of an exemplary embodiment of a display device.

Referring to FIG. 1, an exemplary embodiment of a display device includes a display 10, a pair of sound boxes 20, four fixing members 30, and eight fasteners 40. In this embodiment, the fasteners 40 are screws.

The display 10 has a conventional structure. The display 10 includes a screen 12 (referring to FIG. 4), and a rear cover 14 attached to the back of the screen 12. Four mounting holes 100 are defined in a middle portion of the rear cover 14.

Figure 2:
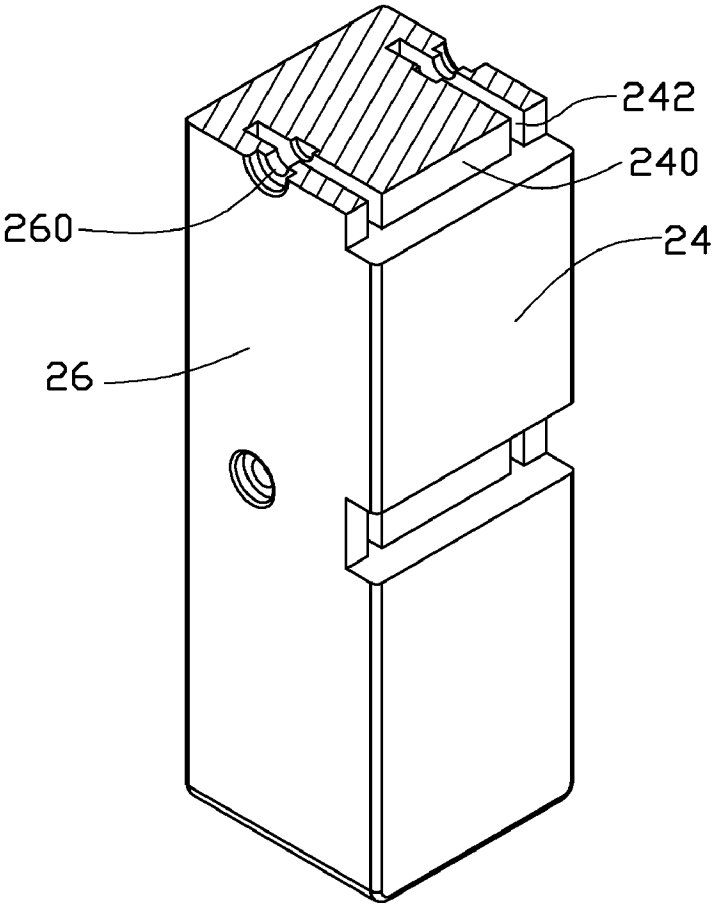
FIG. 2 is an isometric view of a sound box of the display device of FIG. 1, with upper portions of the sound box cut away.
Figure 4:
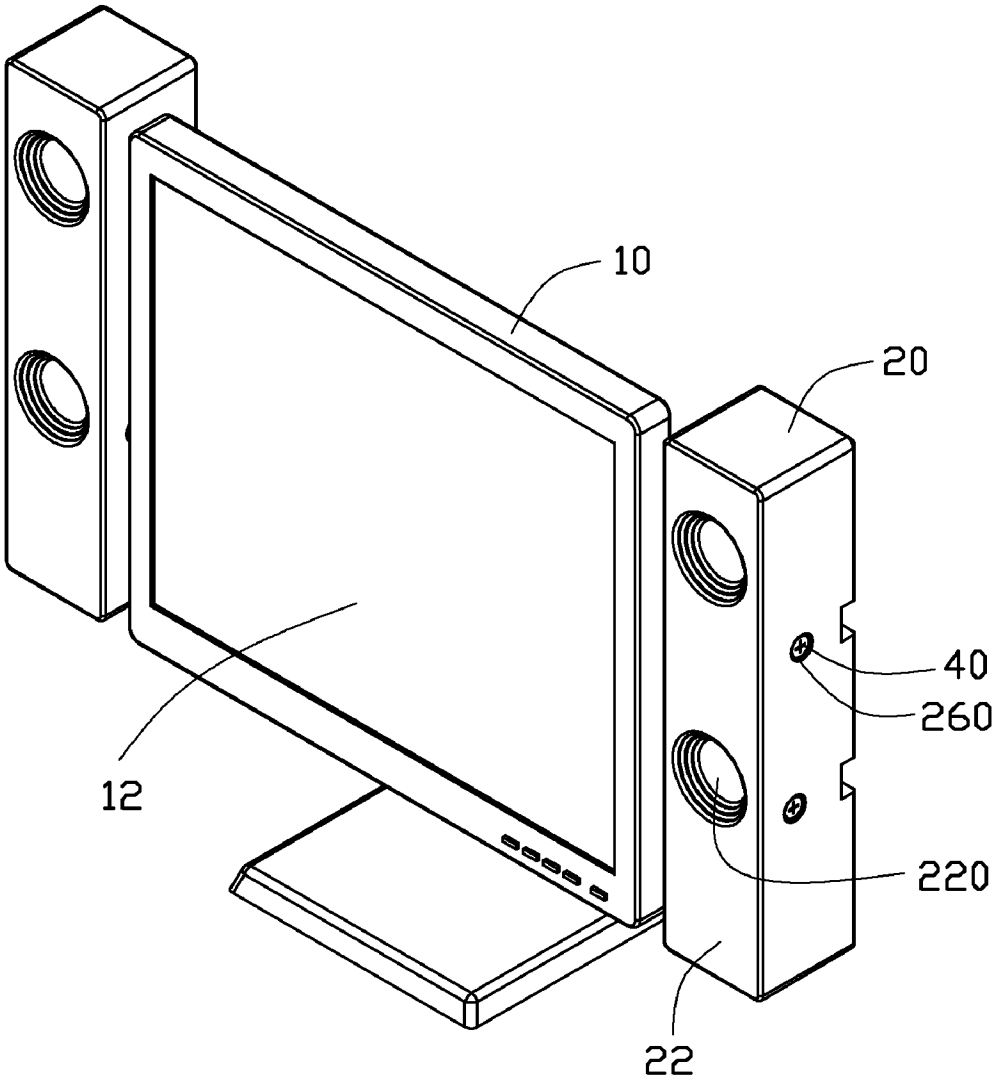

Referring to FIGS. 2 and 4, each of the sound boxes 20 includes a pair of parallel receiving notches 240 defined in a rear wall 24 thereof one above another, two pairs of parallel fixing slots 242 defined therein fro each receiving notch 240 extending in a direction perpendicular to the rear wall 24 and communicating with the receiving notches 240. A pair of speakers 220 set on a front wall 22 thereof. Two pairs of fixing holes 260 respectively defined in opposite sidewalls 26 thereof and communicating the corresponding fixing slots 242.

Each of the fixing members 30 includes a first bar 32, and a second bar 34 perpendicularly extending from one end of the first bar 32. The first bar 32 is longer than the second bar 34. A long sliding slot 320 is defined in the other end of the first bar 32. A long sliding slot 340 is defined in the second bar 34.

Figure 3:
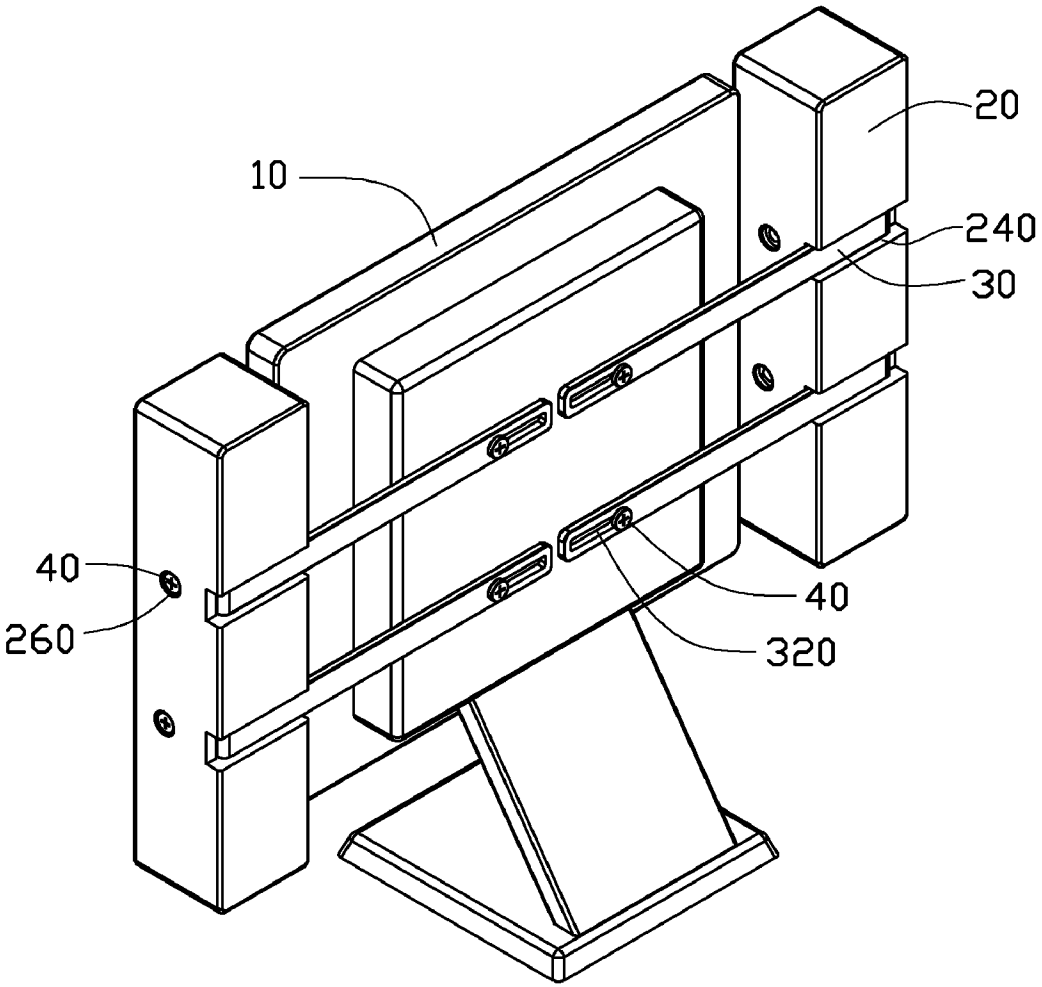
FIGS. 3 and 4 are assembled, isometric views of the display device of FIG. 1, but viewed from different perspectives.

Referring to FIGS. 3 and 4, in assembly of the display device, the sound boxes 20 are attached to the display 10 by the fixing members 30, with the speakers 220 in alignment with the screen 12 of the display 10. The first bars 32 of the four fixing members 30 respectively engage in the four receiving notches 240 of the two sound boxes 20. The second bars 34 of the fixing members 30 selectively engage in the fixing slots 242 of the sound boxes 20. Four fasteners 40 respectively extend through the corresponding fixing holes 260 and the corresponding fixing slots 242 and slidably engage in the long sliding slots 340 of the second bars 34 of the fixing members 30. Four fasteners 40 respectively and slidably extend through the long sliding slots 320 of the first bars 32 of the fixing members 30 to engage in the mounting holes 100 of the rear cover 14 of the display 10. The second bars 34 of the fixing members 30 are capable of selectively engaging in the fixing slots 242 of the sound boxes 20 and the long sliding slots 320, 340 of the fixing members are capable of slidably engaging with the fasteners 40. Thus, the sound boxes 20 can be adjustably attached to the display 10. If the sound boxes 20 are much heavy, the fixing members 30 are adjusted to make the sound boxes 20 lean against the display 10, to prevent the sound boxes 20 from rotating down or tilting to one side.

In other exemplary embodiment, the display device may include two fixing members 30. Each of the sound boxes 20 may include one receiving notch 240, one fixing hole 260, and one fixing slot 242.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A display device comprising:

a display;

a pair of sound boxes; and at least two fixing members adjustably attaching the sound boxes to the display;

wherein each of the at least two fixing members includes a first bar, and a second bar perpendicular to the first bar, the first bar is adjustably mounted on the display and the second bar is adjustably mounted on a corresponding one of the sound boxes;

wherein each of the sound boxes comprises a receiving notch for receiving the first bar of a corresponding one of the at least two fixing members, two fixing slots each communicate with the receiving notch for receiving the second bar of the corresponding fixing member, and two fixing holes each communicate with a corresponding fixing slot for allowing a fastener extending therethrough to engage in the second bar; and wherein the two fixing slots are parallel and extend in a direction perpendicular to a rear wall of the sound box; and the second bar of the corresponding fixing member selectively engages in one of the fixing slots.

2. The display device of claim 1, wherein the display comprises a screen, and a rear cover attached to the back of the screen, a plurality of mounting holes is defined in the rear cover, the first bar of each of the fixing members defines a long sliding slot, and a fastener slidably extends through the long sliding slot of the first bar to engage in a corresponding one of the plurality of mounting holes.

3. The display device of claim 1, wherein the second bar of each of the fixing members defines a long sliding slot, and the fastener extends through the long sliding slot of the second bar to engage with the corresponding sound box.

4. The display device of claim 3, wherein the fixing holes are respectively defined in opposite sidewalls of each sound box, the fastener extends through a corresponding one of the fixing holes, the long sliding slot of the second bar, and the corresponding fixing slot.

* * * * *